US005439315A

United States Patent [19]

MacKenzie et al.

[11] Patent Number: 5,439,315

[45] Date of Patent: Aug. 8, 1995

[54] SYNTHETIC BOOMSTICK

[75] Inventors: Kirk J. MacKenzie, Surrey; William W. G. Liang, Richmond, both of Canada

[73] Assignees: MacMillan Bloedel Limited, Vancouver; Canadian Boomstick Company Ltd., Surrey

[21] Appl. No.: 201,507

[22] Filed: Feb. 24, 1994

[51] Int. Cl.[6] ..... E02B 15/04

[52] U.S. Cl. ..... 405/60.5; 405/63; 405/72

[58] Field of Search ..... 405/60, 60.5, 61, 63, 405/70, 72; 472/127; 441/44, 45, 46, 47, 48, 49, 50, 51; 114/217, 267

[56] References Cited

U.S. PATENT DOCUMENTS

| | | | |
|---|---|---|---|
| 276,789 | 5/1883 | Durell et al. | 441/48 |
| 2,175,197 | 10/1939 | Kent | 472/127 |
| 2,401,453 | 6/1943 | Bell et al. | 441/45 X |
| 2,931,648 | 4/1960 | Davies | 472/127 |
| 4,378,749 | 4/1983 | Leblanc et al. | 114/220 |
| 4,715,307 | 12/1987 | Thompson | 114/267 X |
| 5,006,014 | 4/1991 | Greenough | 465/72 |
| 5,355,825 | 10/1994 | Lefebvre et al. | 114/267 |

FOREIGN PATENT DOCUMENTS 2532255 2/1977 Germany .

*Primary Examiner*—Dennis L. Taylor
*Assistant Examiner*—Howard N. Shipley
*Attorney, Agent, or Firm*—C. A. Rowley

[57] ABSTRACT

A boomstick is formed from an elongated hollow cylindrical body divided into plurality of compartments by axially spaced traversed partitions and enclosed at its end by sealing end caps. Preferably, an axially extending keel forming ballast will be provided to orient the boomstick and axially extending stabilizers will be symmetrically spaced on opposite sides of the body portions spaced from the ballast. The whole boomstick is coated with a polyethylene coating sufficiently thick to protect cylindrical body and to receive the caulks of workmen without damaging the body portion while providing a good retention between the caulks and the coating to better ensure the comfort and safety of the workmen.

21 Claims, 2 Drawing Sheets

SYNTHETIC BOOMSTICK

FIELD OF THE INVENTION

The present invention relates to boomstick, more specifically, the present invention relates to a synthetic boomstick for replacement of conventional boomsticks or the like.

BACKGROUND OF THE PRESENT INVENTION

In conveying or storing of logs in water in the form of log booms or the like, the boundary of the log boom is formed by a plurality of so-called boomsticks. Boomsticks are normally made of wood, i.e. relatively large logs in the order of about 66 feet in length and 2 feet in diameter. The boomsticks are coupled together at their ends by chains or other interconnecting means interconnecting the hooks.

The cost of these boomsticks is relatively high since each contains a substantial amount of generally high value wood that is subject over their period of uses amongst other things to physical abuse, rot, decay, infestation by organism, i.e. sea-worms (teredos) etc. each or which may have a significant influence the life of a boomstick, and its recoverable value.

Attempts have been made to produce synthetic boomsticks to replace the natural or wooden boomstick. For example, U.S. Pat. No. 5,006,014 issued April 1991 to Greenough, discloses a synthetic boomstick formed from old used tires secured together by reinforcing rods and filled with light weight concrete or the like. This system never reached commercial acceptance.

It is also known to use inflated rubber tires on rims that are joined together in side by side relationship to form an elongated barrier (similar or equivalent to boomstick). This system also has not received any significant degree of commercial success. (See Offenlegungsschrift German patent 25 32 255 issued Feb. 3, 1977 to Lochel.)

U.S. Pat. No. 4,378,749 issued Apr. 5, 1983 to Leblanc et al. discloses a barge bumper formed by a plurality of axially-lined tires mounted in side by side relationship on an axially extended pipe.

The use of rubber tires to provide the surface of the boomstick or the like, at first glance, appears to be ideal in that the used tires have tread surfaces which make gripping by caulks on the bottom of the shoes of the workman more easy and provide at least a temporary disposal for used tires. However, it will be apparent that the coefficient of friction of rubber, even though it is wet, is relatively high, and thus, any rubbing action between the periphery or surface of the rubber tires and adjacent logs or the like induces a relatively high strain which in many cases is very detrimental to the operation. Also, the use of rubber tires as the surface of the boomstick inherently limits the ability to apply stabilizers or ballast in the form of axially extending projections and/or a keel to stabilize the boomstick in the water.

BRIEF DESCRIPTION OF THE PRESENT INVENTION

It is an object of the present invention to provide a synthetic boomstick from a coated tubular body.

Broadly, the present invention relates to a boomstick comprising an elongated, hollow ridged cylindrical body section having a longitudinal axis, partition means dividing said body section into a plurality of compartments, an end cap sealing each axial end of said body portion, ballast means fixed to and extending axially of said body portion in a position to orient said body portion with said ballast means submerged and a longitudinally extending tread area uppermost, a coating of a wear and abrasion resistant, water proofing material completely encasing said boomstick, said coating having a coefficient of friction with logs to permit slippage there between, said coating being sufficiently thick to protect said body portion and to receive caulks on boots of workmen walking thereon without damaging said body portion.

Preferably, said coating will be polyethylene.

Preferably, a pair of axially extending stabilizers will be symmetrically positioned on opposite sides of said body portion relative to said ballast means.

Preferably, each of said stabilizers will comprise a hollow, cylindrical section having its cylindrical axis extending longitudinally of said body portion substantial parallel to said longitudinal axis of said body section.

Preferably, said tread area is defined in said polyethylene coating.

Preferably, said ballast means will be formed by material secured to the outside of said body portion and shaped in cross-section to form a keel extending axially of said body portion.

Preferably, said coating will have a minimum thickness of at least 5 mm.

Preferably, said coating will comprise high density polyethylene.

BRIEF DESCRIPTION OF DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
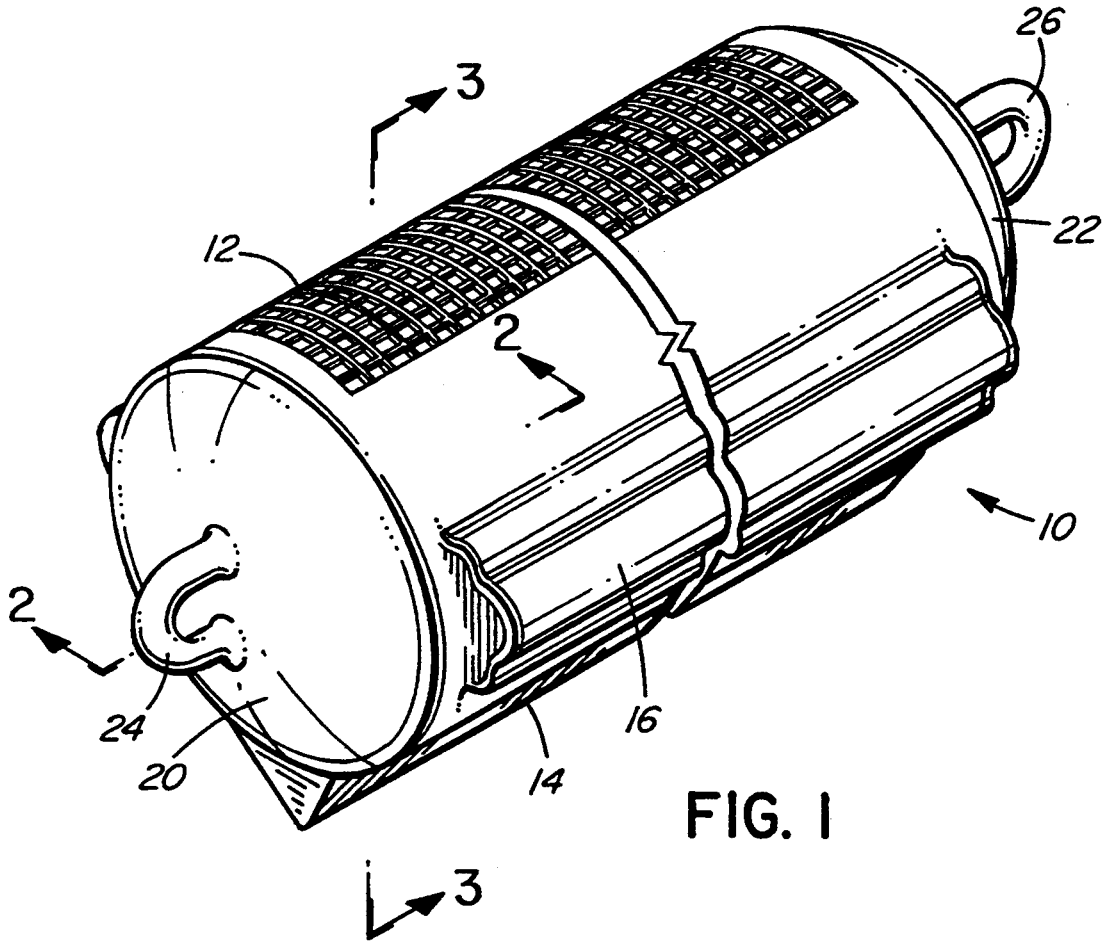
FIG. 1 is an isometric schematic illustration of a boomstick constructed in accordance with the present invention.

As shown in FIG. 1, the boomstick 10 is in the form of an elongated cylindrical having an upper tread surface 12, a lower keel 14, a pair of stabilizers 16 and 18 (see FIG. 3), and a pair of end caps 20 and 22, each provided with its respective eye 24 and 26.

Figure 2:
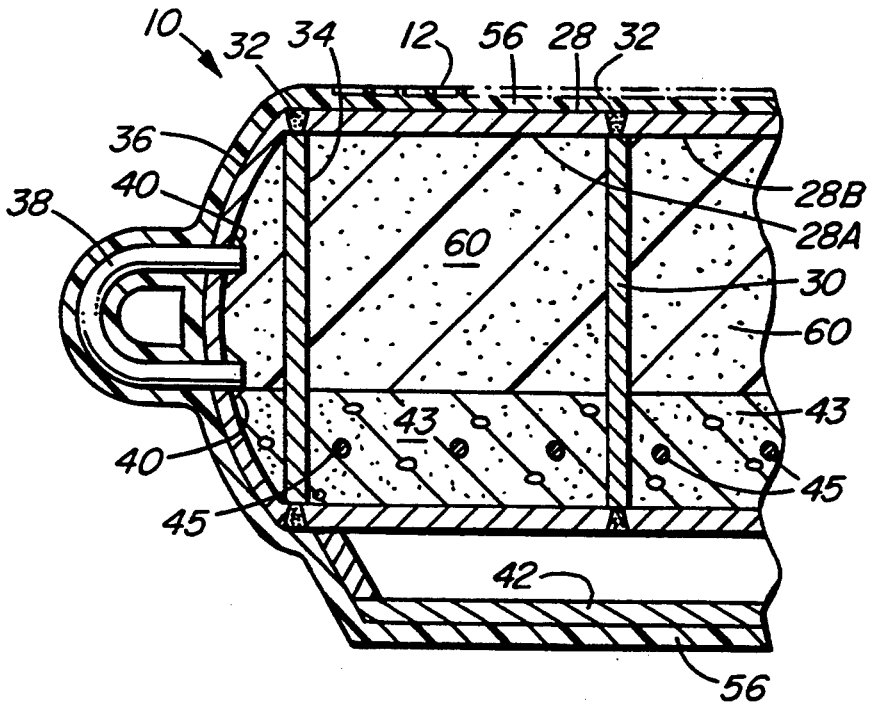
FIG. 2 is a partial axial section along the length of the boomstick taken on line 2—2 of FIG. 3.
Figure 3:
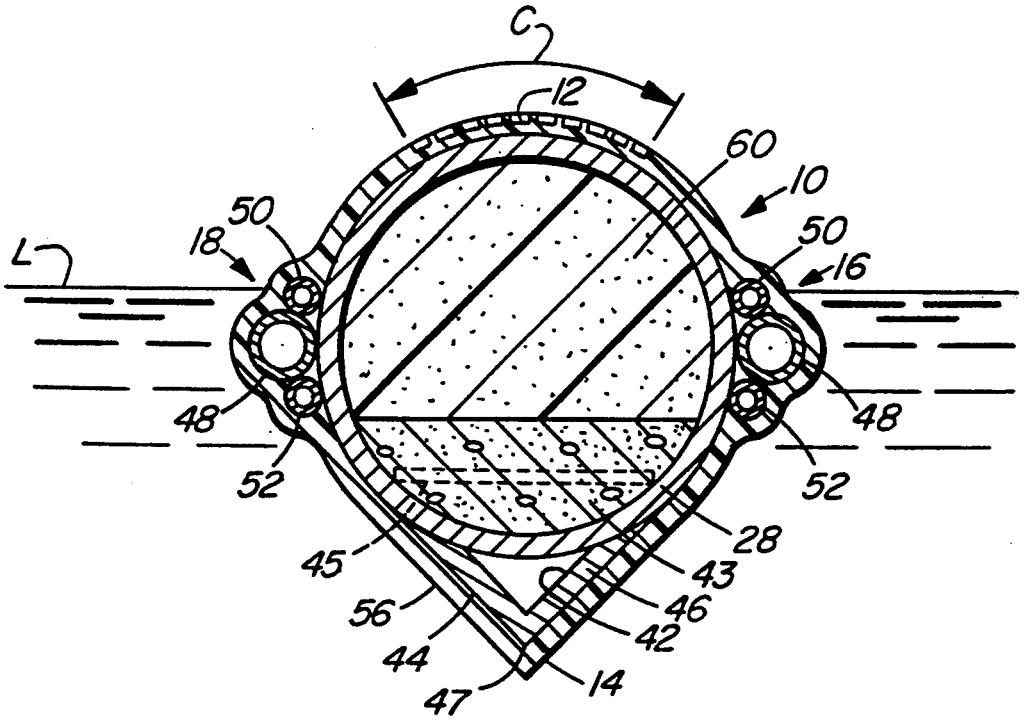
FIG. 3 is a section along the line 3—3 of FIG. 2.

As illustrated in FIGS. 2 and 3, the boomstick 10 is formed from a hollow, cylindrical tube-like body member 28 which may be composed of a plurality of axially aligned tubes 28A, 28B, etc. that are welded together at partitions, such as the partition 30 via circumferential welds indicated at 32. Generally the pipe used to form the body member 28 will have an outside diameter of between 20 and 36 inches, preferably 24 to 30 inches.

A 33 foot long boomstick may be formed with between four to ten sections A, 28B, etc., with each pair of adjacent sections welded together by weld 32 separated from the next adjacent section by its respective partition 30. Thus if desired each tube section 28A, 28B, etc. may form its own air tight floatation compartment.

End closing partitions 34 (only one shown) close off the axial ends of the cylindrical body section 20 and convex or domed end caps 36 (only one shown) are welded or otherwise secured to the tubular body section 28 to provide a convex domed cap, one at each axial end of the boomstick 10.

In the illustrated arrangement, the eyes 24, 26 are each formed by a U-bolt 38 that passes through holes in the end cap 36 and is welded to the end cap as indicated at 40.

A longitudinally extending ballast forming member 42 has been shown welded to the bottom of body member 28, along substantially the full length of the body member 28. The member 42 is preferably an angular member having its apex 47 extending axially of the hollow body member 28 and having its opposite sides 44 and 46 welded or otherwise secured to the body 28 along substantially the full axial length of the body 28. This ballast forming member 42 also functions as keel.

Figure 4:
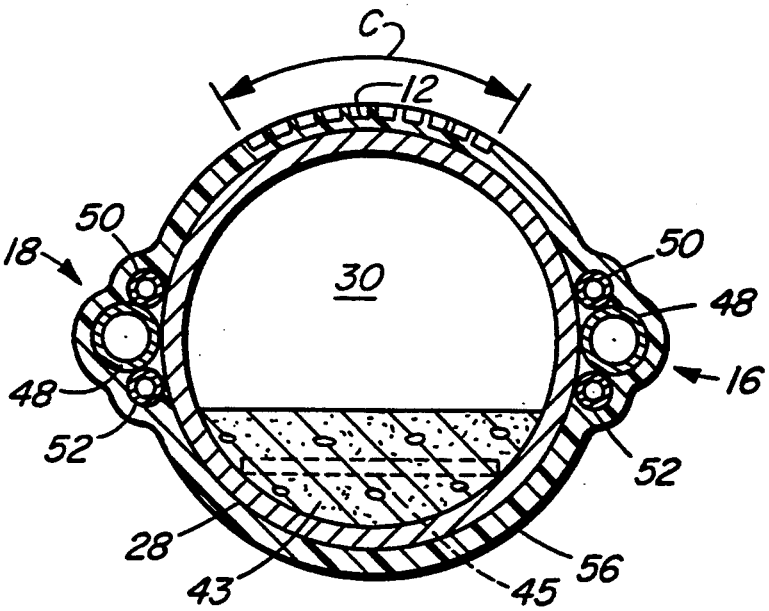
FIG. 4 is a view similar to FIG. 3 but showing a more easily constructed boomstick without a keel.

The use of a ballast forming member 42 as above indicated provides a keel for the boomstick. However, a keel is not absolutely essential to the operation of the device and the provision of the keel renders coating as will be described herein below more difficult. It is thus preferred to use as a ballast a settable material such as concrete or the like as indicated at 43 in FIGS. 3 and 4 wherein the concrete material 43 is positioned within each of the cylindrical body members 28 and is held in proper position, i.e. at a fixed position relative to body section 28 to define the bottom. Concrete is a settable material and thus may be anchored in position by suitable reinforcing rods or the like schematically illustrated at 45 that are welded or otherwise secured to the inside surface of the cylindrical body member 28.

It will be apparent that the ballast 43 (plus the stabilizers 16 and 18) orient the boomstick 10 in the water, where the keel 42 is provided, it may also be desirable to incorporate an appropriate amount of ballast 43 to obtain the required degree of submergence of the boomstick.

The stabilizers 16 and 18 both are essentially the same and are formed, in the illustrated arrangement, by a major (larger diameter) tube member 48 and a pair of smaller tube members 50 and 52 position one above and one below the tube 48. These tubes or pipes 48, 50 and 52 all extend substantially axially along substantially the full length of the body section 28. These tubular members 48, 50 and 52 are all welded together and welded or otherwise secured to the body member 28 and are closed or sealed off by end partitions (not shown).

The longitudinal axes of the stabilizers 16 and 18 are symmetrically positioned on opposite sides of the keel 14 and are preferably positioned at 90° to a longitudinally extending vertical plane passing through the apex 45 of the keel 14.

It will be noted that the pipe 48 is significantly larger in diameter than the pipes 50 and 52 i.e. at least twice that of pipes 50 and 52 and that the pipes 50 and 52 normally will have essentially the same outside diameters. The diameter of the pipes 48 will normally be in the range of about 2 to 4 inches.

This whole unit as above described is then coated with a relatively thick coating 56, generally in the order of at least 5 mm and generally not more than about 15 mm thick. This coating 56 extends over all of the elements above described to completely encase or seal the components of the boomstick 10. The material used will be a wear and abrasion resistant water proofing material having a coefficient of friction with logs to permit slippage there between under normal operating condition. Preferably, the coating material will be an olivinic-type plastic having suitable characteristics and will normally comprise polyethylene, preferably what is known in the trade as high density polyethylene. Preferably, the coefficient of friction of the coating material with logs will not exceed that of polyethylene.

In the illustrated arrangement, the polyethylene coating completely coats the eyes 24 and 26 to completely surround the U-shaped members 38. However, because of the way these U-shaped members are used in conjunction with chains and the like, the coating relatively quickly wears off, but luckily the coating on these U-shaped members 38 is not particularly important.

The upper surface of coating 56 remote from the keel 14, i.e. the tread surface area as indicated at 12 which extends over a significant portion of the circumference of the boomstick 10 expose above the water line L will be suitably treated to provide a tread surface for cooperation with the caulks on a workman's boots. This may be accomplished by striating the plastic or embossing or moulding a suitable pattern into the plastic in the tread area 12, for example to texture the plastic to simulate the bark of a tree or a wood surface so that the workman will be comfortable in walking along the upper tread surface 12 of the boomstick 10 and the cooperation of the caulks and plastic coating in the tread surface area will not increase the hazard of walking on the boomstick to be higher than that of the conventional boomstick.

In the illustrated arrangements, this tread surface 12 is shown to extend substantially the full axial length of the boomstick 10 and over an area occupying over about 50% of the area of the boomstick above the water line under normal conditions and has a circumferential length as indicated by the dimension C in FIG. 3 generally equal to at least about 20% of the circumference of the boomstick.

The body member 28, ballast forming member 42 and the pipes or hollow cylindrical members 48, 50 and 52, forming the stabilizers, may be formed from suitable materials such as steel with the cylindrical sections 28A, 28B, etc., each being formed, for example, from lengths of pipe and with the tubular sections 48, 50 and 52, each being formed of a pipe.

The ballast forming member 42 is preferably in form an angle or the like made from metal such as steel and is welded as above indicated to the body member 28.

These partitions 30 and 34, preferably formed of disks of the same material as the body 28, such as steel, and are welded in place at the same time as the adjacent sections such as sections 28A and 28B of the body 28 are welded together. These partitions, being made of steel, provide reinforcements axially spaced along the length of the boomstick 10 to reduce possibility of the boomstick 10 being deformed.

Rather than having isolated compartments formed by the partitions 30 and 34, the partitions 30 and 34 may be opened (they will still provide the required reinforcing) and the interior free space of the hollow body member 28 be filled with a suitable floatation material 60, for example, a light-weight foam material to provide buoyancy even if there is a puncture in the body 28.

While a conventional boomstick is normally about 66 feet long, it is intended to produce the synthetic boomstick 10 of the present invention about one half of the conventional length and to couple two such synthetic boomstick together to replace a single boomstick as used by the prior art.

Having described the invention, modifications will be evident to those skilled in the art without departing from the scope of the invention as defined in the appended claims.

This invention claimed is:

1. A boomstick comprising an elongated, hollow ridged cylindrical body portion that floats in water, said body portion having a longitudinal axis, partition means dividing said body portion into a plurality of compartments, an end cap sealing each axial end of said body portion, ballast means fixed to and extending longitudinally of said body portion in a position to orient said body portion with said ballast means submerged and a longitudinally extending tread area uppermost, a coating of wear and abrasion resistant water proofing material substantially completely encasing said boomstick, said coating having a coefficient of friction with logs to permit slippage there between, said tread area being formed in said coating, said coating being sufficiently thick to protect said body portion and to receive in said tread area caulks on boots of workmen walking thereon without damaging said body portion, a pair of stabilizers positioned one on each side of said body portion and symetrically relative to said ballast means, each of said stabilizers extending longitudinally of said body portion substantially parallel to said longitudinal axis of said body portion along at least a significant portion of the length of said body portion and each of said stabalizers being on or adjacent to a water line formed along its adjacent side of said body portion when said boomstick is afloat in water to thereby inhibit rotation of said body portion about said longitudinal axis.

2. A boomstick as defined in claim 1 wherein each of said stabilizers is positioned immediately adjacent to its adjacent said side of said body portion.

3. A boomstick as defined in claim 1 wherein each of said stabilizers comprises a hollow, cylindrical section.

4. A boomstick as defined in claim 1 wherein said coefficient of friction is no greater than the coefficient of friction between polyethylene and a log of wood.

5. A boomstick as defined in claim 1 wherein said ballast means is formed by material secured to the outside of said body portion and shaped in cross-section to form a keel extending axially of said body portion.

6. A boomstick as defined in claim 2 wherein said ballast means is formed by material secured to the outside of said body portion and shaped in cross-section to form a keel extending axially of said body portion.

7. A boomstick as defined in claim 3 wherein said ballast means is formed by material secured to the outside of said body portion and shaped in cross-section to form a keel extending axially of said body portion.

8. A boomstick as defined in claim 4 wherein said ballast means is formed by material secured to the outside of said body portion and shaped in cross-section to form a keel extending axially of said body portion.

9. A boomstick as defined in claim 1 wherein said coating has a minimum thickness of at least 5 mm.

10. A boomstick as defined in claim 2 wherein said coating has a minimum thickness of at least 5 mm.

11. A boomstick as defined in claim 4 wherein stud coating has a minimum thickness of at least 5 mm.

12. A boomstick as defined in claim 5 wherein said coating has a minimum thickness of at least 5 mm.

13. A boomstick as defined in claim 6 wherein said coating has a minimum thickness of at least 5 mm.

14. A boomstick as defined in claim 8 wherein said coating has a minimum thickness of at least 5 mm.

15. A boomstick as defined in claim 7 wherein said coating has a minimum thickness of at least 5 mm.

16. A boomstick as defined in claim 1 wherein said coating comprises high density polyethylene.

17. A boomstick as defined in claim 2 wherein said coating comprises high density polyethylene.

18. A boomstick as defined in claim 4 wherein said coating comprises high density polyethylene.

19. A boomstick as defined in claim 5 wherein said coating comprises high density polyethylene.

20. A boomstick as defined in claim 8 wherein said coating comprises high density polyethylene.

21. A boomstick as defined in claim 11 wherein said coating comprises high density polyethylene.

* * * * *